US009273847B2

(12) United States Patent
Breidenassel et al.

(10) Patent No.: US 9,273,847 B2
(45) Date of Patent: Mar. 1, 2016

(54) ILLUMINATION DEVICE AND METHOD FOR PRODUCING AN ILLUMINATION DEVICE

(75) Inventors: Nicole Breidenassel, Bad Abbach (DE); Fabian Reingruber, Munich (DE)

(73) Assignee: OSRAM GMBH, Munich (DE)

( * ) Notice: Subject to any disclaimer, the term of this patent is extended or adjusted under 35 U.S.C. 154(b) by 84 days.

(21) Appl. No.: 13/885,166

(22) PCT Filed: Nov. 4, 2011

(86) PCT No.: PCT/EP2011/069417

§ 371 (c)(1), (2), (4) Date: May 14, 2013

(87) PCT Pub. No.: WO2012/065860

PCT Pub. Date: May 24, 2012

(65) Prior Publication Data

US 2013/0235582 A1 Sep. 12, 2013

(30) Foreign Application Priority Data

Nov. 15, 2010 (DE) ..... 10 2010 043 921

(51) Int. Cl.
*F21V 7/04* (2006.01)
*F21K 99/00* (2010.01)
(Continued)

(52) U.S. Cl.
CPC . *F21V 7/04* (2013.01); *F21K 9/135* (2013.01); *F21K 9/50* (2013.01); *F21V 3/0472* (2013.01); *F21V 3/02* (2013.01); *F21V 7/048* (2013.01);
(Continued)

(58) Field of Classification Search
CPC ..... F21K 9/10; F21K 9/135; F21K 9/50; F21V 3/00; F21V 3/02; F21V 3/04; F21V 3/0472; F21V 7/0066; F21V 7/0008; F21V 7/04; F21V 7/041; F21V 7/06; F21V 7/07; F21V 7/09; F21V 17/00; F21Y 2105/008; F21Y 2103/022
USPC ..... 362/241, 243, 245, 247, 249.02, 255, 362/256, 296.05, 296.08, 311.01, 311.02, 362/311.11
See application file for complete search history.

(56) References Cited

U.S. PATENT DOCUMENTS 6,149,283 A * 11/2000 Conway et al. ..... 362/249.03
6,679,618 B1 1/2004 Suckow et al.
(Continued)

FOREIGN PATENT DOCUMENTS

CN 1171514 A 1/1998
CN 2618045 Y 5/2004
(Continued)

OTHER PUBLICATIONS

English language abstract of EP 1574779A1 of Sep. 14, 2005.
(Continued)

*Primary Examiner* — Y M Lee
(74) *Attorney, Agent, or Firm* — Viering, Jentschura & Partner

(57) ABSTRACT

An illumination device comprising at least one reflector and at least one light generating unit, wherein the at least one reflector is designed and arranged to reflect at least a portion of a light emitted by the at least one light generating unit into a spatial region that cannot be directly irradiated thereby, and the at least one light generating unit comprises at least one illuminating region having a substantially uniform emission characteristic in a circumferential direction of the illumination device.

14 Claims, 11 Drawing Sheets

(51) Int. Cl.

| | |
|---|---|
| ***F21V 3/04*** | (2006.01) |
| *F21Y 101/02* | (2006.01) |
| *F21Y 103/02* | (2006.01) |
| *F21V 3/02* | (2006.01) |
| *F21V 7/06* | (2006.01) |
| *F21V 7/07* | (2006.01) |
| *F21V 23/00* | (2015.01) |

(52) U.S. Cl.
CPC .... *F21V 7/06* (2013.01); *F21V 7/07* (2013.01); *F21V 23/002* (2013.01); *F21Y 2101/02* (2013.01); *F21Y 2103/022* (2013.01)

(56) References Cited

U.S. PATENT DOCUMENTS

| | | | | |
|---|---|---|---|---|
| 7,909,481 | B1 * | 3/2011 | Zhang et al. | 362/249.02 |
| 2003/0193807 | A1 | 10/2003 | Rizkin et al. | |
| 2004/0156199 | A1 * | 8/2004 | Rivas et al. | 362/249 |
| 2006/0250792 | A1 * | 11/2006 | Izardel | 362/247 |
| 2008/0094841 | A1 | 4/2008 | Dahm | |
| 2009/0310368 | A1 * | 12/2009 | Incerti et al. | 362/326 |
| 2010/0254128 | A1 | 10/2010 | Pickard et al. | |
| 2010/0301353 | A1 | 12/2010 | Pabst et al. | |
| 2011/0032708 | A1 * | 2/2011 | Johnston et al. | 362/294 |
| 2012/0241778 | A1 | 9/2012 | Franck et al. | |
| 2012/0262915 | A1 * | 10/2012 | Lin et al. | 362/235 |

FOREIGN PATENT DOCUMENTS

| | | | |
|---|---|---|---|
| CN | 100595479 | C | 3/2010 |
| DE | 20311169 | U1 | 10/2003 |
| DE | 102004025473 | A1 | 6/2005 |
| DE | 102006056700 | A1 | 6/2008 |
| DE | 102007056874 | A1 | 5/2009 |
| DE | 102009048313 | A1 | 4/2011 |
| EP | 1574779 | A1 | 9/2005 |
| EP | 1574779 | B1 | 11/2008 |
| FR | 2816693 | B1 | 6/2003 |
| JP | 10031905 | A | 2/1998 |
| WO | 2006091225 | A1 | 8/2006 |
| WO | 2007130536 | A2 | 11/2007 |
| WO | 2008146229 | A2 | 12/2008 |
| WO | 2009103246 | A1 | 8/2009 |
| WO | 2010128438 | A1 | 11/2010 |

OTHER PUBLICATIONS

English language abstract of JP 10031905 of Feb. 3, 1998.
English language abstract of DE 102004025473A1 of Jun. 23, 2005.
English language abstract of DE 20311169U1 of Oct. 9, 2003.
English language abstract of DE 102006056700A1 of Jun. 5, 2008.
Chinese Office Action (6 pages ) based on CN 201180055026.0 dated Dec. 15, 2014.
German Office Action based on Application No. 10 2010 043 921.5(5 Pages) dated Dec. 16, 2015 (Reference Purpose Only).

* cited by examiner

ILLUMINATION DEVICE AND METHOD FOR PRODUCING AN ILLUMINATION DEVICE

RELATED APPLICATIONS

The present application is a national stage entry according to 35 U.S.C. §371 of PCT application No.: PCT/EP2011/069417 filed on Nov. 4, 2011, which claims priority from German application No. 10 2010 043 921.5 filed on Nov. 15, 2010.

TECHNICAL FIELD

Various embodiments relate to an illumination device including a reflector and at least one light generating unit. Various embodiments relate further to methods for producing a respective illumination device.

BACKGROUND

In particular in the case of LED incandescent lamp retrofit lamps which are provided to replace conventional incandescent lamps and use light-emitting diodes as light sources, it is desirable that emission of light occurs into the greatest possible spatial angle range. Diffusers are normally used for this purpose. However, the diffusers permit beam widening only over a limited angle and, in addition, some of the light radiated into the diffusers is lost since, for example, it is reflected back at the inner side of the diffuser and to some extent is reabsorbed by the surfaces or the LEDs themselves, and the light emitted by the illumination device loses brilliance.

SUMMARY

Various embodiments provide an illumination device, in particular a lamp, having a more uniform light distribution with a simultaneously high light yield or brilliance.

Various embodiments provide an illumination device having at least one reflector and at least one light generating unit (sometimes also called a "package" or "illuminating module"), wherein (a) the at least one reflector is designed and arranged to reflect at least a portion of a light emitted by the at least one light generating unit into a spatial region that cannot be directly irradiated thereby (i.e. by the at least one light generating unit), and (b) the at least one light generating unit includes at least one illuminating region having a substantially uniform emission characteristic in a circumferential direction of the illumination device. By means of the reflector, emission into a relatively large spatial (angular) region is made possible, and the illuminating region with the substantially uniform emission characteristic in a circumferential direction of the illumination device improves the homogeneity of the light emission in the circumferential direction which, for semiconductor light sources, previously resulted from the substantially point-like light emission thereof. Overall, substantially uniform illumination is made possible for the entire spatial (angular) region irradiated by the illumination device.

In particular, the at least one light generating unit may include exactly one light generating unit.

In particular, the light generating unit may emit its light substantially into a front half-space centered around a longitudinal axis of the illumination device, so that the reflector reflects a portion of the light emitted by the at least one light generating unit at least partly into the rear half-space complementary to the front half-space.

The reflector may in particular be configured such that it generally reflects at least a portion of a light incident from the at least one light generating unit away laterally, for example with a greater angle in relation to the longitudinal axis.

A substantially uniform emission characteristic in the circumferential direction may in particular include a luminous intensity fluctuating by not more than 20% in the circumferential direction.

The illumination device, in particular the at least one light generating unit thereof, may have one or more illuminating regions which may be activated separately or jointly. The illuminating regions may adjoin one another and/or be arranged so as to be separated from one another by one or more gaps.

There is a refinement whereby at least one illuminating region is configured to be circular or annular, at least sector by sector. As a result, simple homogenization of the light emission in the circumferential direction is assisted. The illuminating region may in particular be annular or circular.

There is a development whereby the at least one light generating unit has at least one semiconductor light source. Preferably, the at least one semiconductor light source includes at least one light-emitting diode. Given the presence of a plurality of light-emitting diodes, these can light up in the same color or in different colors. A color may be monochromatic (e.g. red, green, blue and so on) or multi-chromatic (e.g. white). In addition, the light emitted by the at least one light-emitting diode may be infrared light (IR-LED) or ultraviolet light (UV-LED). A plurality of light-emitting diodes may generate mixed light; for example white mixed light. The at least one light-emitting diode may contain at least one wavelength-converting luminous substance (conversion LED). The at least one light-emitting diode may be present in the form of at least one individually housed light-emitting diode or in the form of at least one LED chip. A plurality of LED chips may be mounted on a common substrate ("submount"). The at least one light-emitting diode may be equipped with at least one individual and/or common lens for beam guidance, e.g. at least one Fresnel lens, collimator and so on. Instead of or in addition to inorganic light-emitting diodes, e.g. based on InGaN or AlInGaP, organic LEDs (OLEDs, e.g. polymer OLEDs) may generally also be used. Alternatively, the at least one semiconductor light source may have, for example, at least one diode laser. The light generating unit can also be designated a "semiconductor light source package" and, for the case of the use of one or more light-emitting diodes, may be designated an "LED package".

There is also a refinement whereby the at least one light generating unit or the at least one illuminating region has at least one organic light-emitting diode (OLED), including a polymer OLED. The OLED has the advantage that it permits two-dimensional and largely homogenous light emission and in addition can be produced in many forms.

There is also a further refinement whereby the at least one light generating unit or the at least one illuminating region has a plurality of point-like semiconductor light sources. The emitter surfaces of the plurality of point-like semiconductor light sources are preferably arranged so closely to one another that they permit a quasi-uniform light distribution for an observer. Alternatively or additionally, the emitter surfaces may be covered by a common diffuser. On account of the physical proximity to the point-like semiconductor light sources, the diffuser may have a comparatively low level of diffusion, which reduces light losses.

When a diffuser is used, the point-like semiconductor light sources may in particular be individually housed light-emitting diodes or laser diodes.

The point-like semiconductor light sources may alternatively be semiconductor light source chips, in particular LED chips, arranged on a common substrate. The semiconductor light source chips have the advantage that the emitter surface thereof may be arranged very closely adjacent to one another, so that the result is a substantially uniform light emission in the circumferential direction for an observer even without a diffuser.

In particular if no diffuser (dedicated diffuser of an illuminating region and/or diffusely scattering bulb) is used, an increase in efficiency or an increase in light yield is possible. In addition, in this way brilliant light is emitted instead of diffuse light.

There is additionally a refinement whereby the reflector has a reflection surface, in particular a reflective outer side or underside, which is assigned to the at least one light generating unit, is rotationally symmetrical with respect to a longitudinal axis (i.e. is rotationally symmetrical or has n-fold symmetry with n greater than or equal to two, specifically in particular with respect to the longitudinal axis of the illumination device) and, with increasing height (i.e. with increasing distance along the longitudinal axis) from the at least one light generating unit, widens, at least in some sections, with an increasing angle in relation to the longitudinal axis. Such a form may also be designated as trumpet-shaped.

In particular, such a reflector may have a thin rear end, in particular with a low or extremely low diameter. The at least one illuminating region may then in particular project beyond the rear end in the radial direction. For example, an illuminating region may be annular and have an inner diameter which is greater than the diameter of the rear end of the reflector. In addition, the illuminating region may be circular and have a diameter which is greater than the diameter of the rear end of the reflector. There is also a refinement whereby the reflector curves at least partly over the at least one light generating unit, in particular at least one associated illuminating region. This permits reflection of light with high luminous intensity to the side and/or into the rear half-space.

There is a development whereby the illumination device has a plurality of light generating units, which means that an emission characteristic may be configured particularly flexibly.

There is a specific refinement whereby, of the plurality of light generating units, at least one (further) light generating unit irradiates in particular a shadow region or shadow of the reflector, at least to some extent, which further improves emission into a large-area spatial region. The at least one further light generating unit may include one or more point light sources, in particular light-emitting diodes, or else surface emitters, such as at least one OLED or a group of point light sources, in particular semiconductor light sources, covered by a diffuser. The at least one further light generating unit may, for example, be arranged on an upper side of the reflector. Generally, the plurality of light generating units may be arranged on different planes (sections of the longitudinal axis) and, for the purpose of simple assembly, may preferably be aligned in the same direction, in particular toward the front in the direction of the longitudinal axis.

There is also a refinement whereby the reflector is designed to be sleeve-like with an inner side and an outer side and is open on both sides. Both the inner side and the outer side may be irradiated by means of the light generating unit. The inner side may be used, at least in some regions, as a reflector, in particular can at least partly be designed to be reflective. A front, open end of the reflector may be used as a light exit surface, in particular for illuminating the shadow region. This refinement permits uniform illumination in a particularly simple and inexpensive way, specifically also of the upper or front half-space.

An interior of the reflector formed by the inner side can accommodate at least one illuminating region. The reflector may surround the at least one illuminating region, in particular laterally.

There is a development whereby the light generating unit has at least two illuminating regions, wherein the outer side may be irradiated by means of at least one of the illuminating regions and the inner side may be irradiated by means of at least one other of the illuminating regions. The reflector may then in particular be placed on a substrate carrying the at least two illuminating regions in a gap between the illuminating regions.

There is a development whereby the reflector is designed to be sleeve-like with an inner side and an outer side and at least one electric lead is laid in the interior thereof delimited by its inner side. The reflector may in particular be open on one side, wherein an open end is used for the insertion of at least one electric lead. If the reflector is open on only one side, the interior thereof may be protected against direct access from outside.

There is also a refinement whereby the reflector is seated on the light generating unit or is fixed to the latter. This permits a particularly large illuminating region. This refinement may particularly advantageously be used with a sleeve-like reflector open on both sides, since in this way it is possible to dispense with a further light generating unit for illuminating the shadow region. In one development, the reflector, in particular a sleeve-like reflector, may be seated on an illuminating region, e.g. on a covering layer made of silicone. In an alternative refinement, the reflector may be seated on a substrate, in particular a printed circuit board, of the light generating unit or fixed thereto, on which substrate the at least one illuminating region is also arranged.

The seated reflector can simultaneously rest on a light-transmitting bulb curving over the at least one light generating unit, for example be pressed on or fixed by a form fit. This improves mechanical stability of the reflector.

There is, moreover, a refinement whereby the reflector is fixed to a light-transmitting bulb curving over the at least one light generating unit and is arranged in a floating manner above the at least one light generating unit. In this way, fixing the reflector in the area of the at least one light generating unit may be avoided, which can offer assembly advantages.

There is also a refinement for the case in which the reflector is not seated on the at least one light generating unit (e.g. by the reflector being arranged in a floating manner above the light generating unit, wherein the reflector can have been produced independently or can be present as a reflective layer of a bulb), in which the light generating unit has exactly one flatly continuous, in particular circular, illuminating region. This refinement has the advantage that a particularly large lighting surface can be used. This illumination device can in particular be an incandescent lamp retrofit lamp, for example in bulb form or in candle form.

The reflector may be fixed to the bulb on an inner side of the bulb facing the light generating unit(s), for example by means of a force-fitting, form-fitting and/or integral connection. Alternatively, the fixing to the bulb can be carried out on an outer side of the bulb facing away from the light generating unit(s), e.g. by means of a force-fitting, form-fitting and/or integral connection. The fixing to the outer side of the bulb can be done, for example, by means of inserting a reflector (which has previously been produced as an independent component) from outside into an appropriate opening in the bulb, wherein the reflector is seated on a rim of the opening. This illumination device may also be in particular an incandescent lamp retrofit lamp, e.g. in bulb form or in candle form.

There is additionally a refinement whereby the illumination device has a light-transmitting bulb curving over the at least one light generating unit and the reflector is integrated in the bulb. The integration may be implemented, for example, by a reflective coating (e.g. metallization) of the bulb, e.g. on an inner side and/or on an outer side of the bulb. This illumination device may likewise in particular be an incandescent lamp retrofit lamp, e.g. in bulb form or in candle form.

The reflector may be designed to be only mirror-reflecting or specularly reflecting or alternatively to have at least one specularly reflecting area and at least one diffusely reflecting area. Specularly reflecting areas and diffusely reflecting areas may be arranged alternately, e.g. in the form of vertically or horizontally arranged strips.

There is generally a refinement whereby the illumination device is a retrofit lamp, in particular an incandescent lamp retrofit lamp, e.g. in bulb form or in candle form. An incandescent lamp retrofit lamp typically has a light-transmitting covering in the form of a bulb. The bulb may consist of glass or plastic, for example.

Various embodiments provide a method for producing an illumination device which has a light-transmitting bulb curving over the at least one light generating unit, and in which the reflector is integrated in the bulb, wherein the method includes at least the following steps: (a) deforming a bulb having an opening at the tip thereof, such that it curves inward in the area of the tip thereof; (b) silvering the bulb, at least in an area of the tip thereof; and (c) closing the opening.

Step (a) may in particular include heating the bulb in order to assist plastic deformation of the bulb without any risk of breakage. Step (a) may be carried out solely by means of the force of gravity acting on the bulb, in particular heated bulb, or with the aid of at least one shaping tool.

The deforming carried out in step (a) may also include structuring a surface of the bulb, e.g. impressing a structure. In particular, for this purpose the at least one shaping tool may also be used or provided as an embossing die.

The step (b) of silvering the bulb may be implemented, for example, by means of a metallization. The bulb may be silvered in an area of the tip thereof which is larger than, equal to or smaller than the area of the bulb deformed in step (a). The silvering may act on an inner side of the bulb and/or on an outer side of the bulb.

Closing the opening in step (c) may be done, for example, by means of placing a suitable cap thereon. The cap may consist of glass or plastic, for example, and be connected to the bulb by latching, adhesive bonding and/or integral heating. The cap may itself be designed again to be light-transmitting or reflective. Alternatively, closing the bulb may also be done, for example, by fusing of a glass droplet or the like.

Various embodiments provide a method for producing an illumination device, wherein the method includes at least the following steps: (a) deforming a bulb which is closed at the tip thereof such that it curves inward in the area of the tip thereof; and (b) silvering the bulb, at least in an area of the tip thereof. This method may further be configured in a manner analogous to the method described above, relating to an open tip. A step (c) of covering the bulb in the area of the tip thereof, e.g. by means of a cap, can also follow.

Various embodiments provide a method for producing an illumination device in which the reflector is fixed to a light-transmitting bulb curving over the at least one light generating unit, and the reflector is arranged in a floating manner above the at least one light generating unit, wherein the method includes at least the following steps: (a) inserting a reflector from outside into a bulb, in particular in the form of a spherical segment, that is open at the tip thereof; and (b) closing the tip of the bulb with the reflector inserted therein.

BRIEF DESCRIPTION OF THE DRAWINGS

In the following figures, the invention will be described in more detail schematically by using exemplary embodiments. Here, identical or identically acting elements may be provided with identical designations for clarity.

DETAILED DESCRIPTION

The following detailed description refers to the accompanying drawings that show, by way of illustration, specific details and embodiments in which the invention may be practiced.

Figure 1:
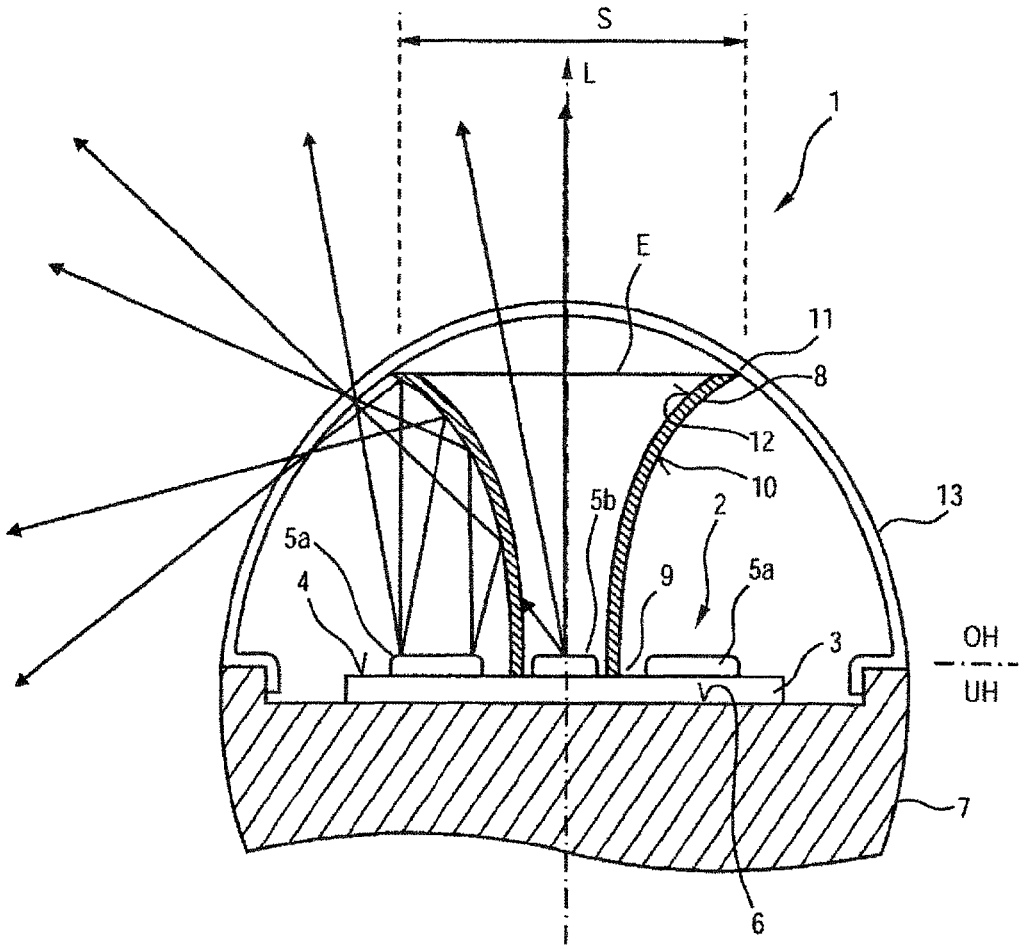
FIG. 1 shows, as a sectional illustration in side view, a detail from an illumination device according to the invention according to a first embodiment.

FIG. 1 shows, as a sectional illustration in side view, a front detail of an illumination device 1 according to the invention in the form of an incandescent lamp retrofit lamp. The illumination device 1 is formed substantially rotationally symmetrically with respect to a longitudinal axis L. The illumination device 1 has a light generating unit 2, wherein the light generating unit 2 has a substrate 3, on the front side 4 of which, pointing in the direction of the longitudinal axis L, two illuminating regions 5*a*, 5*b* are fitted, specifically an annular outer illuminating region 5*a* and a circular inner illuminating region 5*b*. The two illuminating regions 5*a*, 5*b* are separated from each other by an annular gap.

The substrate 3 is thermally conductively fixed by its rear side 6 to a front side of a heat sink 7. A rear side of the heat sink 7, not shown, can merge into a base for the electrical and mechanical connection to a suitable lamp holder.

On the front side 4 of the substrate 3, in the gap between the two illuminating regions 5*a*, 5*b*, a sleeve-like reflector 8 open on both sides is seated by its open, rear end 9.

The reflector 8 is configured and arranged rotationally symmetrically with respect to the longitudinal axis L and has a reflecting outer side 10 assigned to the annular outer illuminating region 5*a* of the light generating unit 2 (i.e. the outer side may be illuminated by the latter). The reflecting outer side 10 widens with increasing height (distance in the direction of the longitudinal axis L) from the light generating unit 2 with an increasing angle in relation to the longitudinal axis L. This can also be designated as a trumpet-like widening. The form of the widening is generally not restricted and may, for example, follow a paraboloid, hyperboloid or free relationship. The reflector 8 may be faceted.

In the embodiment shown, the reflector 8 curves over the annular outer illuminating region 5*a*. The reflector 8 is consequently designed and arranged to reflect a portion of a light emitted by the at least one light generating unit 2, more precisely a portion of a light emitted by the annular outer illuminating region 5*a*, into a spatial region that cannot be irradiated directly by the latter. While the illuminating regions 5*a* and 5*b* shine into an upper half-space OH centered around the longitudinal axis L, the reflector 8 effects an intensified lateral emission and also an emission of light into a lower half-space UH complementary to the upper half-space OH.

By means of the reflector 8, in front of the illumination device 1 with respect to the annular outer illuminating region 5*a*, there is created a shadow region S, which cannot be illuminated by the annular outer illuminating region 5*a*. In order to achieve the largest possible illuminated spatial angle region, the circular inner illuminating region 5*b* is provided to illuminate the shadow region S. To this end, the reflector 8 surrounds the circular inner illuminating region 5*b* laterally. The light emitted by the circular inner illuminating region 5*b* emerges either directly from a light exit surface E of the reflector 8 (which is spanned by an upper rim 11 of the reflector 8) or emerges from the light exit surface E only after at least one reflection at an inner side 12 of the reflector 8 facing the circular inner illuminating region 5*b*, at least in some regions. The inner side 12 is likewise designed to be reflective for this purpose. The reflective outer side 10 and the reflective inner side 12 may in particular be designed to be specularly or alternatively diffusely and specularly reflective in some areas.

As a result of the configuration of the illuminating regions 5*a* and 5*b* and of the reflector 8, a substantially homogeneous luminous intensity with respect to a polar angle in relation to the longitudinal axis L may be established. In order to achieve a substantially uniform or constant emission characteristic, in particular a substantially constant luminous intensity, in the circumferential direction as well (with a varied azimuth angle), the illuminating regions 5*a* and 5*b* of the light generating unit 2 also have a substantially uniform emission characteristic in the circumferential direction of the illumination device 1.

Figure 2:
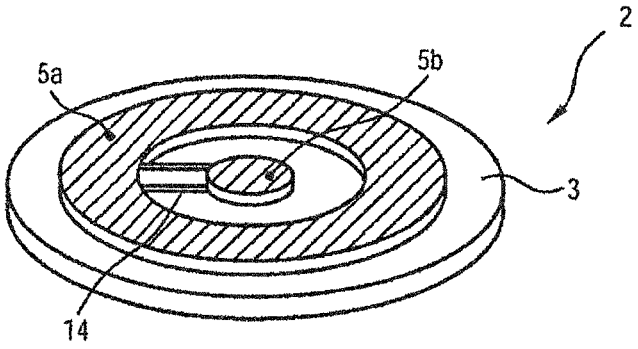
FIG. 2 shows, in a view obliquely from above, a possible configuration of a light generating unit of the illumination device according to the first embodiment.

A hemispherical, light-transmitting bulb 13, which is fixed to the heat sink 7, also curves over the light generating unit 2. A hemispherical bulb 13 permits simple production with a simultaneously large heat sink 7. The bulb 13 also makes contact with the upper rim 11 of the reflector 8, so that it presses the reflector 8 slightly onto the substrate 3, which means that high mechanical stability is achieved. In addition, in this way the substrate 3 may also be fixed in a manner pressing on the heat sink 7. The reflector 8 may also be used as a heat spreading element and heat conducting element, e.g. to carry waste heat generated by the light generating unit 2 away to the bulb 13. The bulb 13 may be used as an additional heat sink. The bulb 13 may consist of glass or plastic, for example. The bulb 13 may in particular be transparent in order to avoid light losses and to achieve high brilliance. FIG. 2 shows, in a view obliquely from above, a possible configuration of the light generating unit 2 of the illumination device 1. The two illuminating regions 5*a* and 5*b* of the light generating unit 2, arranged on the printed circuit board 3, are connected to each other via connecting elements 14 (e.g. electric leads) and may be driven jointly.

There is a development whereby the illuminating regions 5*a*, 5*b* are formed by one or two surface emitters, in particular by organic light emitting diodes (OLEDs). The illuminating regions 5*a*, 5*b* may therefore correspond at least approximately to the emitter surfaces of a single OLED or two OLEDs (analogously to the respective illuminating regions 5*a*, 5*b*). The illuminating regions 5*a*, 5*b* may in particular be driven jointly. The use of the surface emitters makes a constant luminous intensity in the circumferential direction possible in a simple way. It is possible to dispense with a diffuser for covering the surface emitter.

Figure 3A:
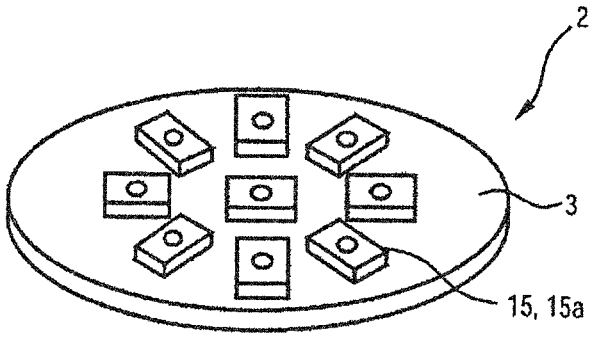
FIG. 3A shows, in a view obliquely from above, a possible arrangement of point light sources in the light generating unit of the illumination device according to the first embodiment.

There is a further development, as shown in FIG. 3A, whereby the illuminating regions 5*a*, 5*b* each have at least one point light source 15 in the form of an individually housed point light source 15*a*, in particular an LED, wherein each of the illuminating regions 5*a*, 5*b* is covered by a respective common diffuser (without figure). The light radiated by the diffuser preferably has a fluctuation of no more than 20% in the luminous intensity in the circumferential direction. This development permits a high luminous intensity with low costs, wherein the diffuser needs to have an only low level of scatter, on account of the physical proximity to the individually housed point light sources 15*a*. The substrate 3 may be formed here, for example, as a printed circuit board.

Figure 3B:
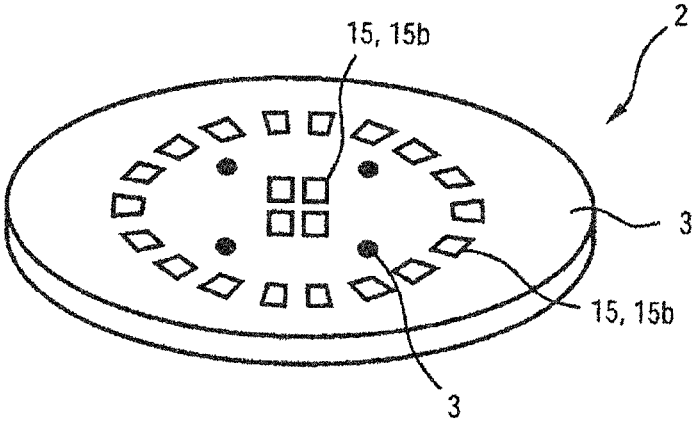
FIG. 3B shows, in a view obliquely from above, a further possible arrangement of point light sources of the light generating unit of the illumination device according to the first embodiment.

The arrangement of the individually housed point light sources 15*a* here, stated more precisely, is such that individually housed point light sources 15*a* assigned to annular outer illuminating region 5*a* are lined up annularly in a row, preferably without any spacing or with only a small spacing. The circular inner illuminating region 5*b* is illuminated by means of only one (centrally arranged) individually housed point light source 15*a*. There is a further development, shown in FIG. 3B, whereby the illuminating regions 5*a*, 5*b* have in each case at least one point light source 15, in particular an LED, in the form of a light-emitting chip, in particular an LED chip 15*b*. The surfaces of the light-emitting chips 15*b* correspond substantially to the emitter surfaces thereof, so that the emitter surfaces can be arranged directly adjacent to one another particularly closely and with only a small spacing. As a result, a luminous intensity that is quasi-constant in the circumferential direction is made possible, in which it is possible to dispense with a diffuser covering the point light source(s). The substrate 3 may be present here, in particular, as a ceramic substrate.

The above-described illumination device 1 permits light emission distributed substantially uniformly over the illuminated spatial region.

Specifically, if no diffuser (dedicated diffuser of an illuminating region and/or diffusely scattering bulb) is used, quite generally an increase in efficiency or in an increase in light yield of the illumination device 1 is possible. In particular, in this way brilliant light instead of diffuse light is emitted by the illumination device 1. Such an illumination device 1 may even blind less than a conventional incandescent lamp, since a greater emitting surface visible to an observer is present.

Quite generally, instead of the one light generating unit 2 having two or more illuminating regions 5*a*, 5*b*, two or more light generating units each having one or more illuminating regions may also be used. Each of the light generating units may in particular be distinguished by the fact that it has been produced separately before mounting on the illumination device. The plurality of light generating units may be drivable separately or jointly. A light generating unit may also be designated as a "package" or as an "illuminating module".

Figure 4:
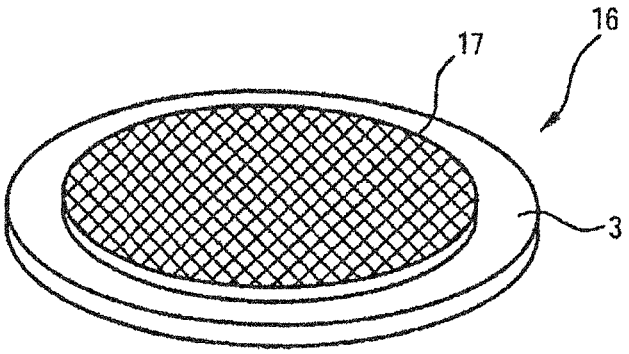
FIG. 4 shows, in a view obliquely from above, a further possible configuration of a light generating unit.

FIG. 4 shows, in a view obliquely from above, yet another possible configuration of a light generating unit 16. The light generating unit 16 differs from the light generating unit 2 in that it has only a single, circular illuminating region 17. The illuminating region 17 may, for example, have a diameter the same as or similar to the outer, annular illuminating region 5*a*. The illuminating region 17 may likewise be formed by means of an OLED (or a plurality of OLEDs, in particular arranged adjacently) or, for example, by means of a group of point light sources, possibly having a common diffuser, circular here.

Figure 5:
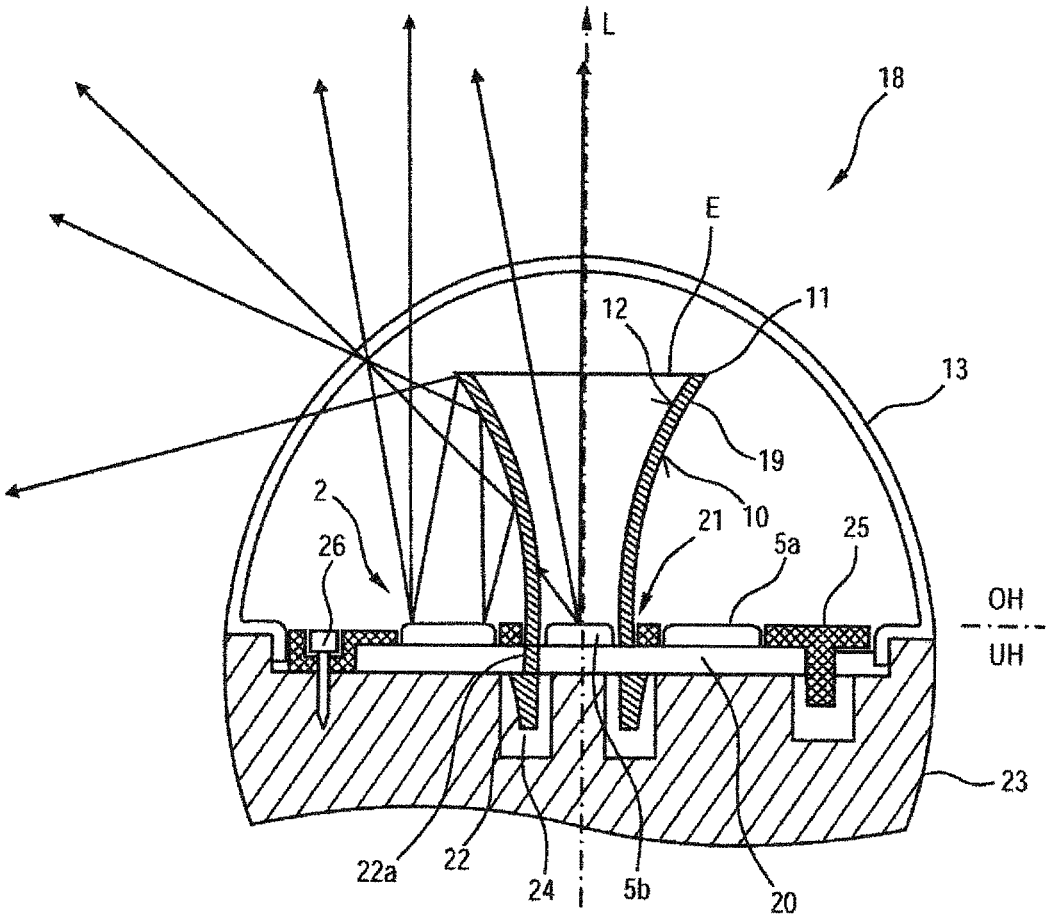
FIG. 5 shows, as a sectional illustration in side view, a detail from an illumination device according to the invention according to a second embodiment.

FIG. 5 shows, as a sectional illustration in side view, a detail from an illumination device 18 according to the invention according to a second embodiment. The illumination device 18 is constructed similarly to the illumination device 1, wherein, now, however, the reflector 19 does not reach as far as the bulb 13 and only partly covers the annular outer illuminating region 5*b*. As a result, the reflector 19 is no longer fixed in a clamping manner between the bulb 13 and the printed circuit board. In order nevertheless to achieve stable standing of the reflector 19 on the printed circuit board 20 in the gap between the illuminating regions 5*a* and 5*b*, the reflector 19 has on the lower rim 21 thereof snap action hooks or latching lugs 22 adjoining in the rearward direction, which are led through matching lead-throughs 22*a* in the printed circuit board 20 and engage behind the printed circuit board 20. The heat sink 23 has cutouts 24 provided for the insertion of the latching hooks 22. Alternatively or additionally, the reflector 19 can be adhesively bonded onto the printed circuit board 20.

The fact that the upper rim 11 of the reflector 19 is narrow makes it possible for the near-field area, in which noticeable shadowing may be seen on an outer side of the bulb 13, to be kept small.

In addition to the illumination device 1, the illumination device 18 has a further reflector 25 on the bottom side, which is placed on the printed circuit board 20 and the heat sink 23 from the front and in the process cuts out the outer annular illuminating region 5*a*. Light yield is improved by the bottom-side reflector 25. The bottom-side reflector 25 may have a fixed base and be adhesively bonded on, snapped on or, as shown, screwed on by means of at least one screw 26. The bottom-side reflector 25 may also be used to fix the printed circuit board 20 to the heat sink 23.

Figure 6:
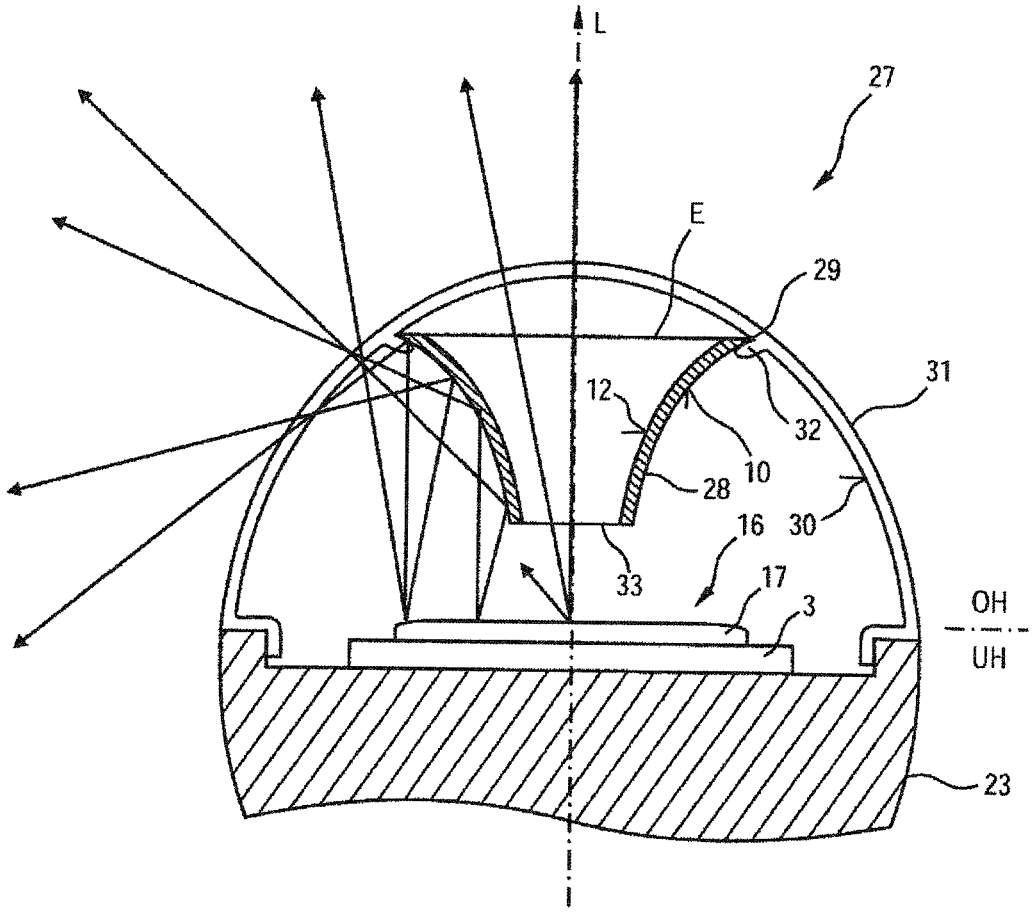
FIG. 6 shows, as a sectional illustration in side view, a detail from an illumination device according to the invention according to a third embodiment.

FIG. 6 shows, as a sectional illustration in side view, a detail from an illumination device 27 according to a third embodiment. The illumination device 27, as opposed to the illumination devices 1 and 18, has a reflector 28 which is fixed with the upper rim 29 thereof on an inner side 30 of the bulb 31 by adhesive bonding and/or snap action and so on. The bulb 31 may have latching protrusions 32 for this purpose.

The reflector 28 is arranged in a floating manner above a light generating unit 16. The lower open end 33 of the reflector 28 therefore has a spacing with respect to the longitudinal axis from the light generating unit 16. As a result of avoiding direct contact between the illuminating region/the illuminating regions, use of the light generating unit 16 with the one circular illuminating region 17 is made easier, so that, inter alia, a higher luminous intensity is made possible.

Figure 7:
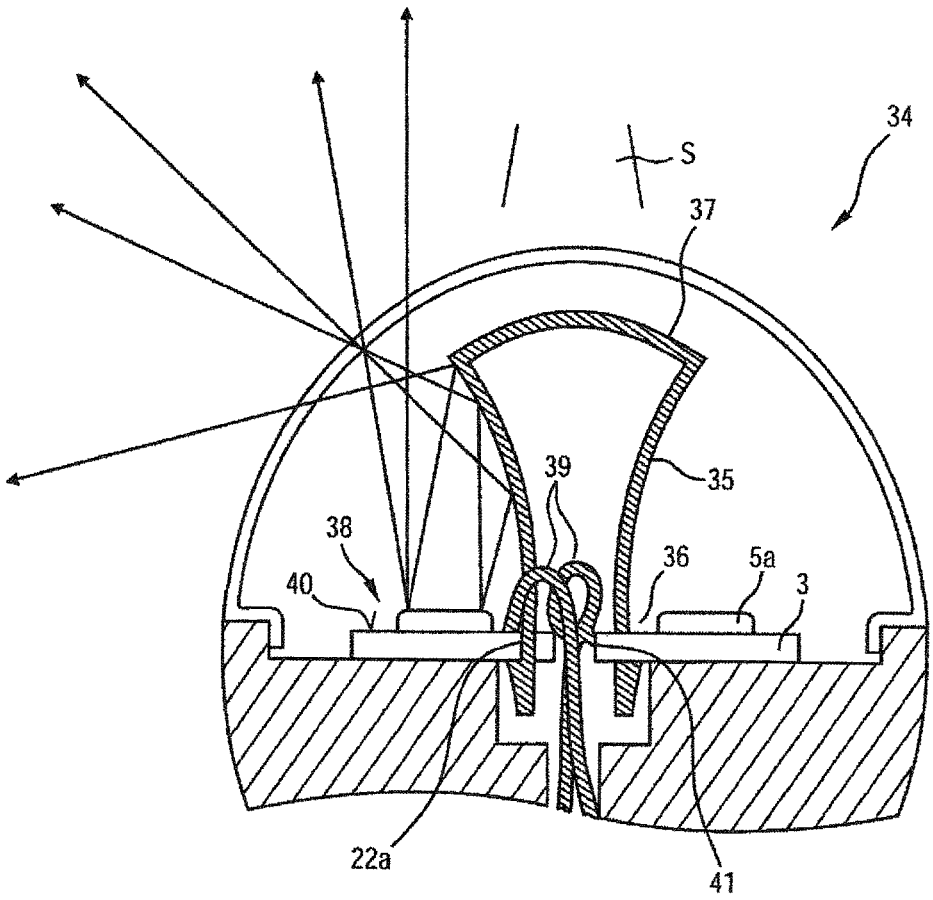
FIG. 7 shows, as a sectional illustration in side view, a detail from an illumination device according to the invention according to a fourth embodiment.

FIG. 7 shows, as a sectional illustration in side view, a detail from an illumination device 34 according to a fourth embodiment, which is constructed similarly to the illumination device 18. The illumination device 34 now has a reflector 35 which is not open on both sides but only at the lower end 36 thereof. The upper end 37 is closed.

A light generating unit 38 consequently has only one annular illuminating region 5*a*.

Since the reflector 35 only partly covers the annular illuminating region 5*a*, it may be configured in such a way that, even without the inner illuminating region 5*b*, at least in the far field, the whole of the upper half-space OH is sufficiently illuminated by the annular illuminating region 5*a*. The shadow region S thus exists only in the near field of the illumination device 34.

The (hollow) reflector 35 is additionally used as a protective covering for electric leads 39, which are in particular laid out from a driver cavity (without figure) of the heat sink through the printed circuit board 40. The electric leads 39 may in particular connect a driver accommodated in the driver cavity electrically to a respective contact area on the upper side of the printed circuit board 40 in order to feed the illuminating region 54*a*.

Figure 8:
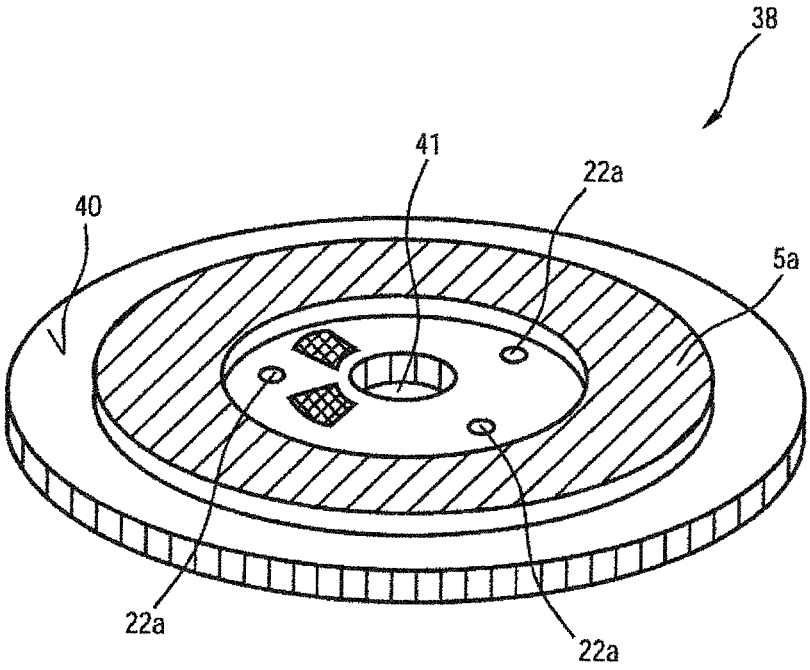
FIG. 8 shows, in a view obliquely from above, a possible configuration of a light generating unit of the illumination device according to the fourth embodiment.

FIG. 8 shows, in a view obliquely from above, a possible configuration of the light generating unit 38. The light generating unit 38 has the annular illuminating region 5*a* and, in the middle, a cable lead-through opening 41.

Figure 9:
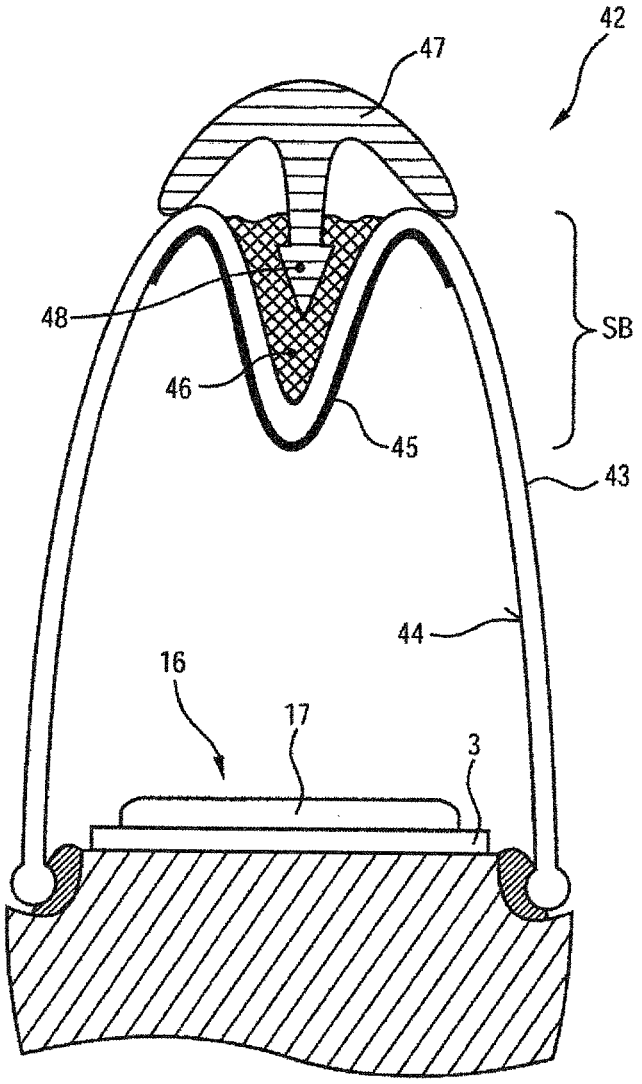
FIG. 9 shows, as a sectional illustration in side view, a detail from an illumination device according to the invention according to a fifth embodiment.

FIG. 9 shows, as a sectional illustration in side view, a detail from an illumination device 42 according to a fifth embodiment. The illumination device 42 is present in the form of an incandescent lamp retrofit lamp with a candle-like basic shape.

As opposed to the illumination devices previously described, which use a separately produced reflector, the reflector is now integrated in the bulb 43, specifically here in the form of a reflective layer 45, for example a metallization, applied to an inner side 44 of the bulb 43. The bulb 43 is shaped suitably in the tip region SB thereof, in order to achieve the most large-area and homogenous distribution of the luminous intensity. For the purpose of illumination, use is made of a light generating unit 16, wherein a diameter of the circular illuminating region 17 is greater than a lateral or radial extent or diameter of the reflective layer 45, in order, at least in the far field, to avoid a shadow region caused by the reflecting layer 45. The reflecting layer 45 is likewise arranged 'floating' above the light generating unit 16.

The deformation of the bulb 43 in the tip region SB thereof may be done, for example, by pressing in a forwardly projecting tip of a bulb shaped in particular similarly to a conventional incandescent lamp. In order to cover the pressed-in tip region SB in order to achieve the conventional candle shape, a depression present on the outside may be filled with adhesive 46 and a cap 47 can subsequently be placed on the tip region SB. The cap 47 here has a central anchoring region 48, which is anchored in the adhesive 46, for fastening.

FIGS. 10A to 10D show, as a sectional illustration in side view, various steps of a method sequence for producing a reflecting bulb 49 of an illumination device. The bulb 49 may, for example, be used instead of the combination of the bulb 31 and the reflector 28 with the illumination device 27. The bulb 49 may consist of glass, for example.

Figure 10A:
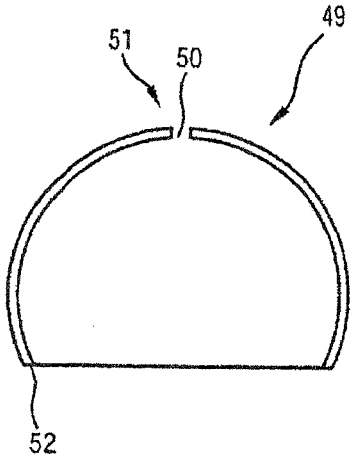
FIGS. 10A to 10D show, as a sectional illustration in side view, various steps of a method sequence for producing a reflective bulb of an illumination device according to the invention.

FIG. 10A shows the bulb 49 of spherical shell segment shape before processing, with an opening 50 in the (front) tip 51 thereof and a lower rim 52, which is narrower than the equator (plane of the widest diameter).

In a first processing step, the bulb 49 may be heated for the deformation of the same.

Figure 10B:
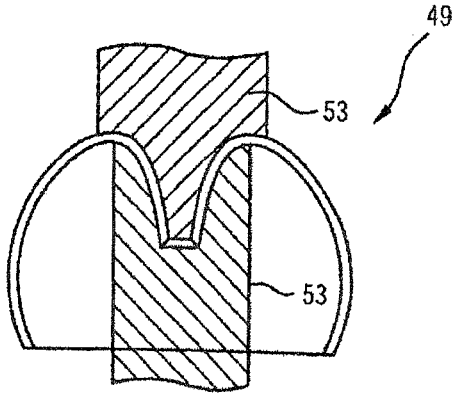

FIG. 10B shows a second processing step, in which the bulb 49 is curved inward in the region of the tip 51 thereof by placing shaping tools on two sides, here in the form of dies 53. Via these dies 53, structures may also be embossed in the bulb 49, such as for example the honeycomb structure characteristic of reflectors.

Figure 10C:
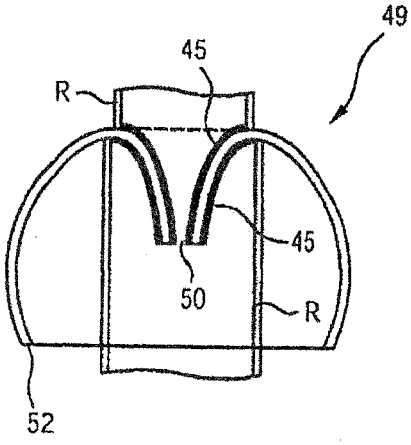

FIG. 10C shows a following processing step, in which the bulb is silvered on both sides in the region of the tip 51 thereof, specifically with a reflecting layer 45, for example a metallization layer.

By means of inserting covering tubes R, the regions of the bulb 49 that are not to be silvered are protected.

Figure 10D:
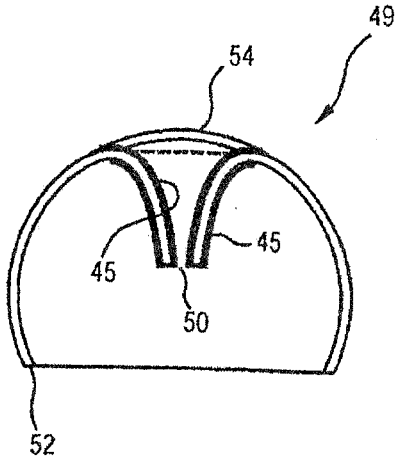

FIG. 10D shows how the opening 50 (widened in the meantime) is closed by placing and fixing a cupola or cap 54, made of glass here. The fixing may be carried out, for example, by adhesive bonding or heating.

Figure 11A:
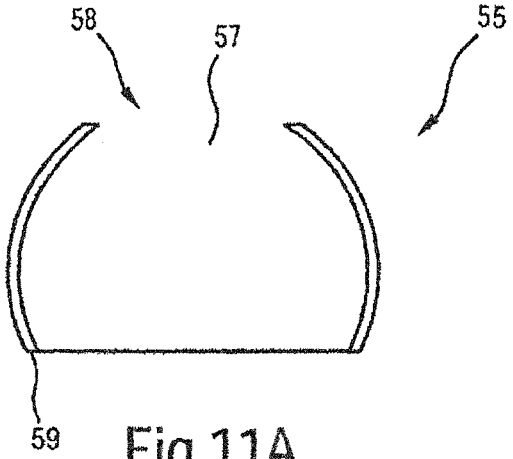
FIGS. 11A and 11B show, as a sectional illustration in side view, various steps of a method sequence for marrying a bulb with a reflector of an illumination device according to the invention.
Figure 11B:
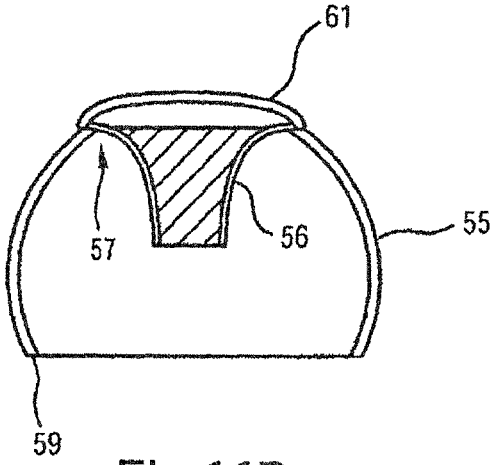

FIGS. 11A to 11B show, as a sectional illustration in side view, various steps of a method sequence for marrying a bulb 55 with a reflector 56. This combination 55, 56 may be used, for example, instead of the combination of the bulb 31 and the reflector 28 with the illumination device 27. The bulb 55 may consist of glass, for example.

As shown in FIG. 11A, the bulb 55 also has the shape of a spherical segment or spherical shell segment here and has an opening 57 in the (front) tip 58 thereof, and also a lower rim 59 which is narrower than the equator.

In this method, the bulb 55 is not deformed but, as shown in FIG. 11B, the reflector 56 is inserted into the opening 57 from outside. The reflector 56 preferably projects at no point beyond the rim defining the opening 57. Consequently, the opening 57 with the reflector 56 inserted therein is closed by means of a cap 61. The cap 61 fixes the reflector 56. It is advantageous if the reflector 56 is suspended only at 3 points and sprung slightly horizontally, in order that the structure is not stressed during heating.

The bulb 55 and the cap 61 preferably consist of glass.

The illumination devices silvered on the bulbs thereof have the advantage that they have a high-quality appearance since, as a result of the silvering, the cap, for example, appears to consist exclusively of glass and metal, specifically even when an adhesive has also been used.

Figure 12:
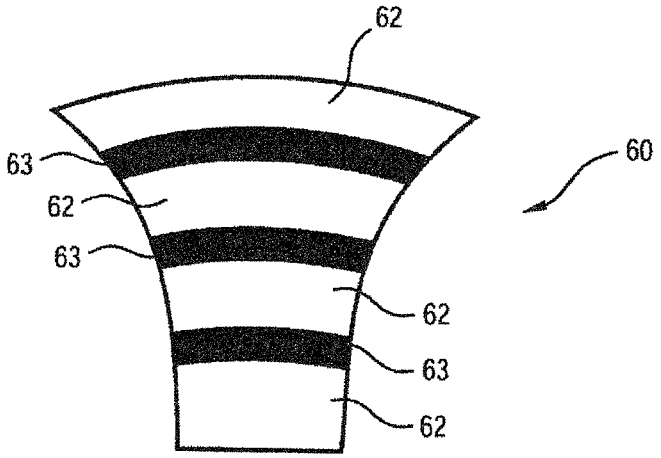
FIG. 12 shows, in side view, a specularly and diffusely reflecting reflector.

FIG. 12 shows, in side view, a specularly and diffusely reflecting reflector 60. The reflector 60 has alternating horizontal strip-like regions, specifically specularly reflecting regions 62 and diffusely reflecting regions 63.

Figure 13:
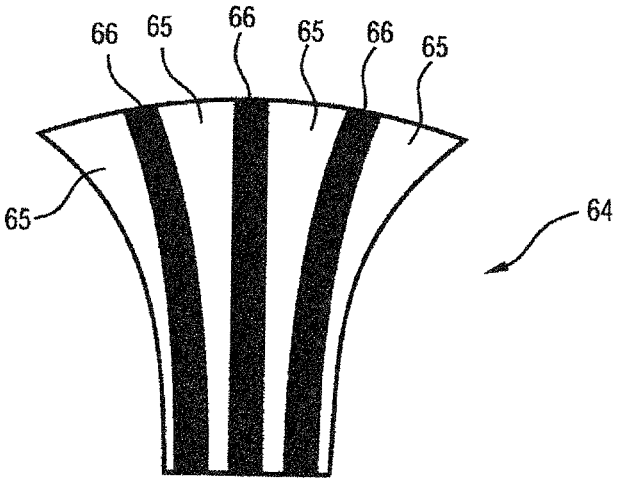
FIG. 13 shows, in side view, a further specularly and diffusely reflecting reflector.

FIG. 13 shows, in side view, a further specularly and diffusely reflecting reflector 64, which now has alternating vertical strip-like regions, specifically specularly reflecting regions 65 and diffusely reflecting regions 66.

As a result of the use of specularly reflecting regions and diffusely reflecting regions, a desired spatial angle distribution can be matched even more accurately.

Of course, the present invention is not restricted to the exemplary embodiments shown. Thus, the bottom-side reflector can be used in other illumination devices apart from in the illumination device according to the second embodiment.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF DESIGNATIONS

1 Illumination device
2 Light generating unit
3 Substrate
4 Front side of the substrate
5*a* Outer illuminating region
5*b* Inner illuminating region
6 Rear side of the substrate
7 Heat sink
8 Reflector
9 Rear end of the reflector
10 Outer side of the reflector
11 Rim of the reflector
12 Inner side of the reflector
13 Bulb
14 Connecting element
15 Point light source
16 Light generating unit
17 Illuminating region
18 Illumination device
19 Reflector
20 Printed circuit board
21 Lower rim of the reflector
22 Latching lug
22*a* Lead-through
23 Heat sink
24 Cutout
25 Reflector
26 Screw
27 Illumination device
28 Reflector
29 Upper rim of the reflector
30 Inner side of the bulb
31 Bulb
32 Latching protrusion
33 Open end of the reflector
34 Illumination device
35 Reflector
36 Lower end of the reflector
37 Upper end of the reflector
38 Light generating unit
39 Electric lead
40 Printed circuit board
41 Cable lead-through opening
42 Illumination device
43 Bulb
44 Inner side of the bulb
45 Reflecting layer
46 Adhesive
47 Cap
48 Anchoring region
49 Bulb
50 Opening

51 Tip
52 Lower rim of the bulb
53 Die
54 Cap
55 Bulb
56 Reflector
57 Opening
58 Tip
58 Lower rim of the bulb
59 Reflector
60 Cap
62 Specularly reflecting region
63 Diffusely reflecting region
64 Reflector
65 Specularly reflecting region
66 Diffusely reflecting region
L Longitudinal axis
E Light exit surface
S Shadow region
OH Upper half-space
UH Lower half-space
SB Tip region
R Covering tube

The invention claimed is:

1. An illumination device comprising at least one reflector and at least one light generating unit, wherein:

the at least one reflector is designed and arranged to reflect at least a portion of a light emitted by the at least one light generating unit into a spatial region that cannot be directly irradiated thereby;

the at least one light generating unit comprises at least one illuminating region having a substantially uniform emission characteristic in a circumferential direction of the illumination device;

wherein the reflector is designed to be sleeve-like with an inner side and an outer side and is open on both ends and wherein both the inner side and the outer side can be irradiated by means of the light generating unit, and wherein the light generating unit has a single illuminating region which irradiates both the outer side and the inner side of the reflector.

2. The illumination device as claimed in claim 1, wherein at least one illuminating region is configured to be circular or annular, at least sector by sector.

3. The illumination device as claimed in claim 1, wherein the at least one light generating unit has at least one OLED.

4. The illumination device as claimed in claim 1, wherein the at least one light generating unit has a plurality of point-like semiconductor light sources, in the form of semiconductor light source chips.

5. The illumination device as claimed in claim 1, wherein the reflector has a reflective outer side which is assigned to the at least one light generating unit, is rotationally symmetrical with respect to a longitudinal axis and, with increasing height from the at least one light generating unit, widens, at least in some sections, with an increasing angle in relation to the longitudinal axis.

6. The illumination device as claimed in claim 5, wherein the reflector curves at least partly over the at least one light generating unit.

7. The illumination device as claimed in claim 1, wherein the reflector is seated on the light generating unit.

8. The illumination device as claimed in claim 1, wherein the reflector is fixed to a light-transmitting bulb curving over the at least one light generating unit and is arranged in a floating manner above the at least one light generating unit.

9. The illumination device as claimed in claim 1, wherein the illumination device has a light-transmitting bulb curving over the at least one light generating unit and the reflector is integrated in the bulb.

10. The illumination device as claimed in claim 1, wherein the light generating unit has exactly one circular illuminating region.

11. The illumination device as claimed in claim 1, wherein the illumination device is a retrofit lamp.

12. The illumination device as claimed in claim 1, wherein the at least one light generating unit has a plurality of point-like semiconductor light sources, arranged annularly, in the form of semiconductor light source chips.

13. The illumination device as claimed in claim 1, wherein the illumination device is an incandescent lamp retrofit lamp.

14. A method for producing an illumination device, the illumination device comprising at least one reflector and at least one light generating unit, wherein the at least one reflector is designed and arranged to reflect at least a portion of a light emitted by the at least one light generating unit into a spatial region that cannot be directly irradiated thereby, the at least one light generating unit comprises at least one illuminating region having a substantially uniform emission characteristic in a circumferential direction of the illumination device, the reflector is designed to be sleeve-like with an inner side and an outer side and is open on both sides and wherein both the inner side and the outer side can be irradiated by means of the light generating unit, and the light generating unit has exactly one circular illuminating region, the method at least comprising: deforming a bulb having an opening at the tip thereof, such that it curves inward in the area of the tip thereof; silvering the bulb, at least in an area of the tip thereof; closing the opening.

* * * * *

UNITED STATES PATENT AND TRADEMARK OFFICE

CERTIFICATE OF CORRECTION

PATENT NO. : 9,273,847 B2
APPLICATION NO. : 13/885166
DATED : March 1, 2016
INVENTOR(S) : Nicole Breidenassel et al.

It is certified that error appears in the above-identified patent and that said Letters Patent is hereby corrected as shown below:

In The Specification

Column 11, line 21: Please write the number "49" between the words "bulb" and "is" in place thereof.

Column 13, line 9: Please delete the number "58" in front of the words "Lower rim of the bulb" and write the number "59" in place thereof.

Column 13, line 10: Please delete the number "59" in front of the word "Reflector" and write the number "60" in place thereof.

Column 13, line 11: Please delete the number "60" in front of the word "Cap" and write the number "61" in place thereof.

Signed and Sealed this
Twelfth Day of July, 2016

Michelle K. Lee

Michelle K. Lee
*Director of the United States Patent and Trademark Office*